US008333601B2

(12) United States Patent
Nakashima

(10) Patent No.: US 8,333,601 B2
(45) Date of Patent: Dec. 18, 2012

(54) TRANSPORTABLE DEVICE

(75) Inventor: Akira Nakashima, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 13/204,454

(22) Filed: Aug. 5, 2011

(65) Prior Publication Data

US 2012/0045914 A1 Feb. 23, 2012

(30) Foreign Application Priority Data

Aug. 23, 2010 (JP) ..... 2010-185737

(51) Int. Cl.
*H01R 13/62* (2006.01)

(52) U.S. Cl. ..... 439/160; 439/911; 361/679.59

(58) Field of Classification Search ..... 439/160, 439/911; 361/679.59
See application file for complete search history.

(56) References Cited

U.S. PATENT DOCUMENTS

| | | | | |
|---|---|---|---|---|
| 4,387,951 | A * | 6/1983 | Hall et al. | 439/299 |
| 4,931,907 | A * | 6/1990 | Robinson et al. | 361/727 |
| 6,081,419 | A * | 6/2000 | Pham | 361/617 |
| 6,388,880 | B1 * | 5/2002 | El-Ghobashy et al. | 361/695 |
| 6,439,917 | B2 * | 8/2002 | Tonozuka | 439/372 |
| 6,491,226 | B1 * | 12/2002 | Nishioka | 235/475 |
| 6,671,160 | B2 * | 12/2003 | Hayden | 361/212 |
| 6,902,421 | B1 * | 6/2005 | Huang | 439/372 |
| 6,913,473 | B2 * | 7/2005 | Schmid et al. | 439/136 |
| 7,044,780 | B2 * | 5/2006 | Ma | 439/553 |
| 7,056,143 | B2 * | 6/2006 | Arbogast et al. | 439/362 |
| 7,091,670 | B2 * | 8/2006 | Pruett et al. | 315/219 |
| 7,143,940 | B2 * | 12/2006 | Abundis et al. | 235/435 |
| 8,090,285 | B2 * | 1/2012 | Masuda | 399/88 |
| 2004/0184833 | A1 * | 9/2004 | Ise | 399/90 |
| 2012/0045914 | A1 * | 2/2012 | Nakashima | 439/160 |

FOREIGN PATENT DOCUMENTS

| | | | |
|---|---|---|---|
| JP | 9-188031 | A | 7/1997 |
| JP | 2005-326709 | A | 11/2005 |
| JP | 2006-285170 | A | 10/2006 |

* cited by examiner

*Primary Examiner* — Ross Gushi
(74) *Attorney, Agent, or Firm* — Birch, Stewart, Kolasch & Birch, LLP

(57) ABSTRACT

A transportable device includes a housing, a handle portion, a biasing portion, a locking portion, a lever portion, and a link portion. The housing has a power plug insertion opening into which a power plug is inserted. The handle portion can move between the inside and outside of the housing. The biasing portion biases the handle portion in the direction where the handle portion is moved to the outside of the housing. The locking portion locks the handle portion so that the handle portion does not move to the outside of the housing by a biasing force of the biasing portion. The lever portion moves in the insertion direction of the power plug when the power plug is inserted into the opening, while moving in the pull-out direction of the power plug when the power plug is pulled out. The link portion links the locking portion and the lever portion.

7 Claims, 9 Drawing Sheets

TRANSPORTABLE DEVICE

CROSS REFERENCE

This Nonprovisional application claims priority under 35 U.S.C. §119(a) on Patent Application No. 2010-185737 filed in Japan on Aug. 23, 2010, the entire contents of which are hereby incorporated by reference.

BACKGROUND OF THE INVENTION

The present invention relates to a transportable device that is operated by receiving power supply.

In recent years, transportable personal computers and word processors and the like have become popular, and subsequently, easily transportable printers have also become familiar.

Conventionally, a handle portion has been provided in a position where a main body of the image forming apparatus is easily held in order that transportation work can be surely performed for a case that two or more persons transport an image forming apparatus (a printer) of a medium size or larger. Such a handle portion has some types. Representative examples include: a handle portion that have recesses or projections integrally provided with a housing of an image forming apparatus on the lower parts of both sides of the main body of the image forming apparatus; and a drawer type handle portion that is supported on the bottom of an image forming apparatus so as to be projectable and retractable, and is used to be manually drawn outside only at the time of transportation of the image forming apparatus.

In order to improve the transportability of an image forming apparatus, it is insufficient to simply reduce the size and weight of the image forming apparatus and it is necessary to provide a handle portion suitable for the transportation of the image forming apparatus. In addition, it is also necessary to consider safety to prevent operation mistakes by users such as a fall accident due to a wrong transportation method caused by ease of using the image forming apparatus having a small size and a light weight.

In attempt to overcome such a problem, an image forming apparatus has been disclosed which is provided with a handle portion that is covered by a cover member when the image forming apparatus is used, and is exposed from the cover member covering the handle portion as the cover member shifts to a retreated position according to operation of disconnecting cables from the main body of the image forming apparatus when the image forming apparatus is not used, that is, when the image forming apparatus is transported; and which is capable of being transported only when the handle portion is exposed (refer to Japanese Patent Laid-Open Publication No. 09-188031, for example).

However, the image forming apparatus disclosed in Japanese Patent Laid-Open Publication No. 09-188031 includes a main device and a subordinate device, and only the main device has a cover member which can cover a handle portion and the subordinate device does not have such a cover member in the handle portion. Thus, even in the case where a power cord is attached to the subordinate device, the subordinate device can be transported, so that a risk arises when a user tries to transport the subordinate device accidentally in the state in which the power cord is still attached to the subordinate device.

In view of the above-stated problems, it is an object of the present invention to provide a transportable device that cannot be transported in a state in which a power plug is inserted into a power plug insertion opening.

SUMMARY OF THE INVENTION

A transportable device according to the present invention includes a housing, a handle portion, a biasing portion, a locking portion, a lever portion, and a link portion. The housing has a power plug insertion opening into which a power plug is inserted. The handle portion can move between the inside and the outside of the housing. The biasing portion biases the handle portion in the direction in which the handle portion is moved to the outside of the housing. The locking portion is for locking the handle portion so that the handle portion is not moved to the outside of the housing by a biasing force of the biasing portion. The lever portion can move in the insertion direction or in the pull-out direction of the power plug around the power plug insertion opening, and moves in the insertion direction of the power plug when the power plug is inserted into the power plug insertion opening while moving in the pull-out direction of the power plug when the power plug is pulled out. The link portion links the locking portion and the lever portion.

The locking portion locks the handle portion in response to the link portion moving as the lever portion moves in the insertion direction of the power plug in conjunction with the power plug being inserted into the power plug insertion opening, and releases the locking of the handle portion in response to the link portion moving as the lever portion moves in the pull-out direction of the power plug in conjunction with the power plug being pulled out of the power plug insertion opening. The handle portion is moved to the outside of the housing by the biasing force from the biasing portion when the power plug is pulled out of the power plug insertion opening and then the locking by the locking portion is released.

In this structure, the handle portion is kept retracted in the inside of the housing in a state in which the power plug is inserted into the power plug insertion opening, and the handle portion is not moved to the outside of the housing as long as the power plug is not pulled out of the power plug insertion opening. In other words, when a user holds the handle portion and transports the transportable device, the power plug is in the state in which the power plug is pulled out of the power plug insertion opening.

Accordingly, the situation that the user transports the transportable device by holding the handle portion in the state in which the power plug is inserted into the power plug insertion opening does not occur, so that occurrence of damage to the power cord due to a load being applied to the power cord can be avoided. In addition, a risk that the user drops the transportable device because his or her hands slip due to the tension can be also avoided since tension from the power cord is not applied to the transportable device.

The foregoing and other features and attendant advantages of the present invention will become more apparent from the reading of the following detailed description of the invention in conjunction with the accompanying drawings.

DETAILED DESCRIPTION OF THE INVENTION

Hereinafter, transportable devices according to embodiments of the present invention will be described in detail with reference to the drawings.

To begin with, a first embodiment of the present invention is described below.

Figure 1:
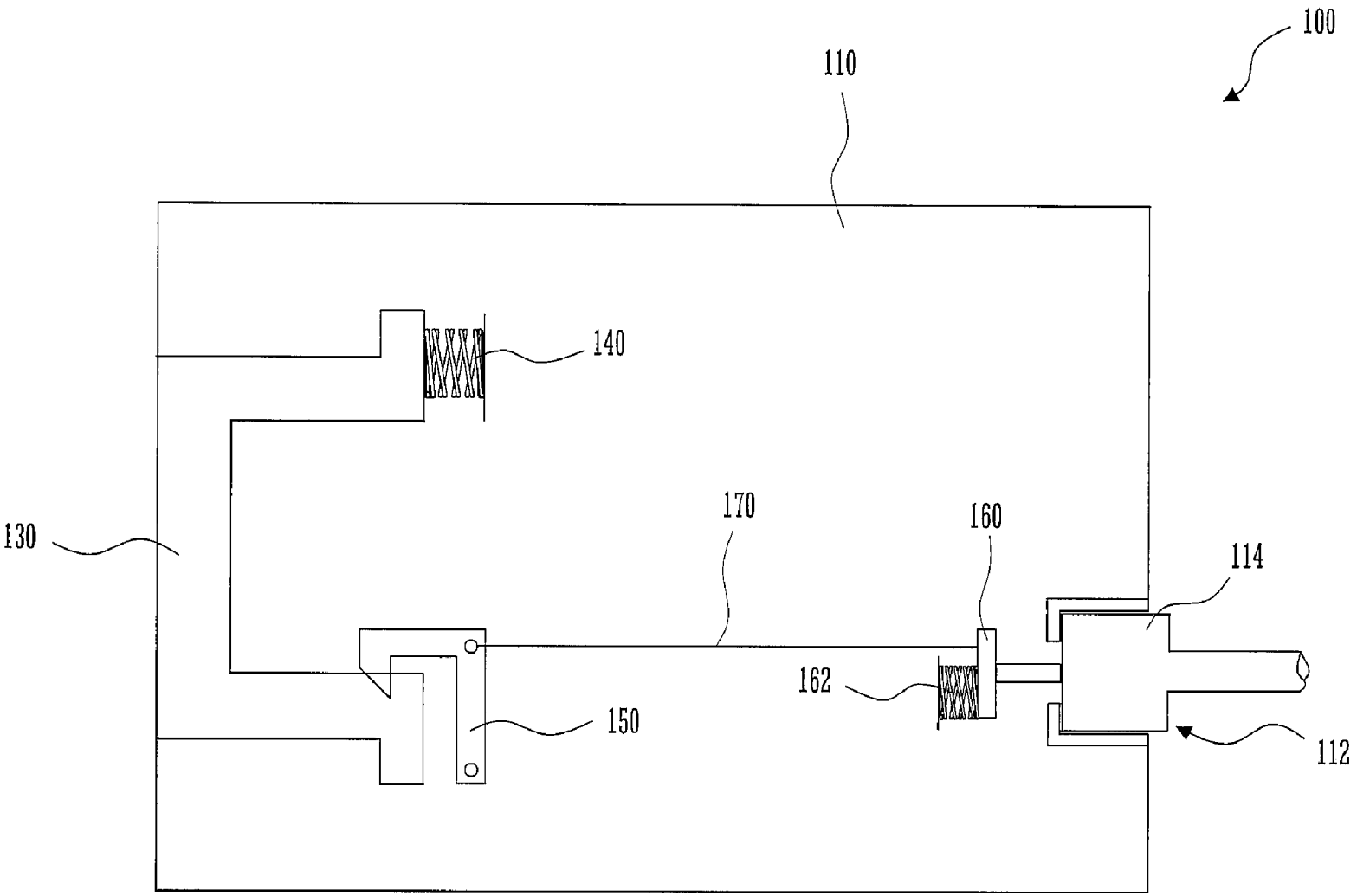
FIG. 1 is a figure showing a related structure when transporting a transportable device according to a first embodiment of the present invention.
Figure 2:
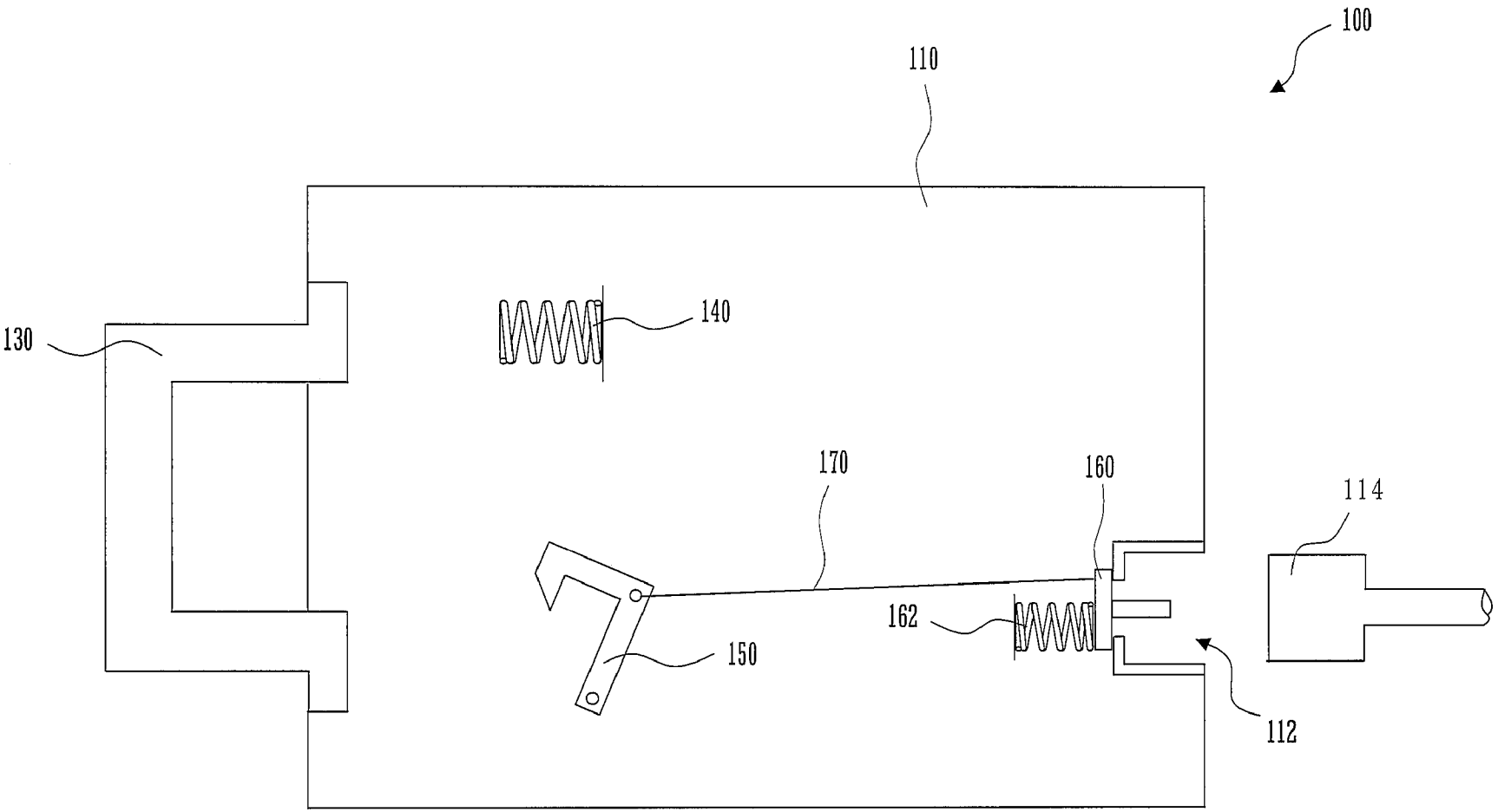
FIG. 2 is a figure showing a related structure when transporting the transportable device according to the first embodiment of the present invention.

FIG. 1 and FIG. 2 are figures showing a related structure when transporting a transportable device 100 according to the first embodiment of the present invention.

The transportable device 100 includes a housing 110, a handle 130, a compression spring 140, a lock claw 150, a lever portion 160, and a link portion 170. The transportable device 100 is equivalent to a device that a user can transport such as a scanner, a personal computer, or an image forming apparatus. The handle 130 corresponds to a handle portion of the present invention. The compression spring 140 corresponds to a biasing portion of the present invention. The lock claw 150 corresponds to a locking portion of the present invention.

The housing 110 has a power plug insertion opening 112 into which a power plug 114 is inserted. The handle 130 can move between the inside and the outside of the housing 110. The compression spring 140 biases the handle 130 in the direction in which the handle is moved to the outside of the housing 110. The lock claw 150 is for locking the handle 130 so that the handle 130 may not be moved to the outside of the housing 110 by the biasing force of the compression spring 140.

The lever portion 160 can move in the insertion direction or in the pull-out direction of the power plug 114 around the power plug insertion opening 112, and moves in the insertion direction of the power plug 114 when the power plug 114 is inserted into the power plug insertion opening 112 while moving in the pull-out direction of the power plug 114 when the power plug 114 is pulled out.

In other words, the lever portion 160 moves in the pull-out direction of the power plug 114 when the power plug 114 is pulled out of the power plug insertion opening 112 because the lever portion is biased by the compression spring 162 in the pull-out direction of the power plug 114. On the other hand, the lever portion 160 is moved in the insertion direction of the power plug 114 by a press of the power plug 114 when the power plug 114 is inserted into the power plug insertion opening 112. The link portion 170 links the lock claw 150 and the lever portion 160.

The lock claw 150, as shown in FIG. 1, locks the handle 130 when the lever portion 160 moves in the insertion direction of the power plug 114 in conjunction with the power plug 114 being inserted into the power plug insertion opening 112. On the other hand, as shown in FIG. 2, the lock claw 150 releases the locking of the handle 130 through the link portion 170 when the lever portion 160 moves in the pull-out direction of the power plug 114 in conjunction with the power plug 114 being pulled out of the power plug insertion opening 112.

The handle 130 is moved to the outside of the housing 110 by the biasing force from the compression spring 140 when the power plug 114 is pulled out of the power plug insertion opening 112 and then the locking by the lock claw 150 is released.

In this structure, the handle 130 is kept retracted in the inside of the housing in the state in which the power plug 114 is inserted into the power plug insertion opening 112, and the handle 130 does not move to the outside of the housing 110 as long as the power plug 114 is not pulled out of the power plug insertion opening 112. That is to say, when a user holds the handle 130 and transports the transportable device 100, the power plug 114 is in the state in which the power plug 114 is pulled out of the power plug insertion opening 112.

Thus, a situation that the user transports the transportable device 100 by holding the handle 130 in the state in which the power plug 114 is inserted into the power plug insertion opening 112 does not occur, so that occurrence of damage to the power cord due to the load being applied to the power cord can be avoided. In addition, since tension from the power cord is not applied to the transportable device 100, a risk that the user drops the transportable device 100 because his or her hands slip due to the tension can be also avoided.

Figure 3:
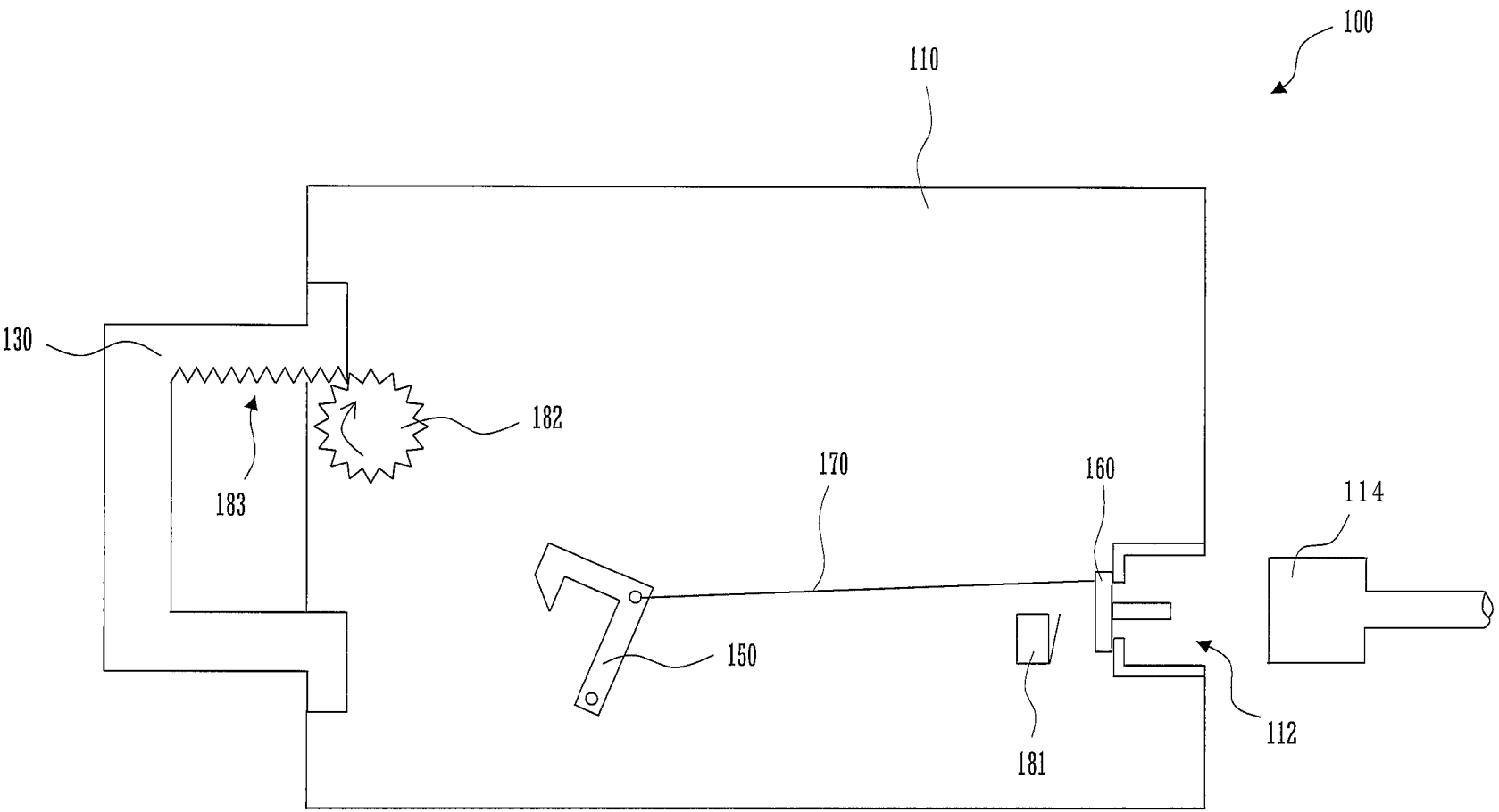
FIG. 3 is a figure showing a related structure after having transported the transportable device according to the first embodiment of the present invention.
Figure 4:
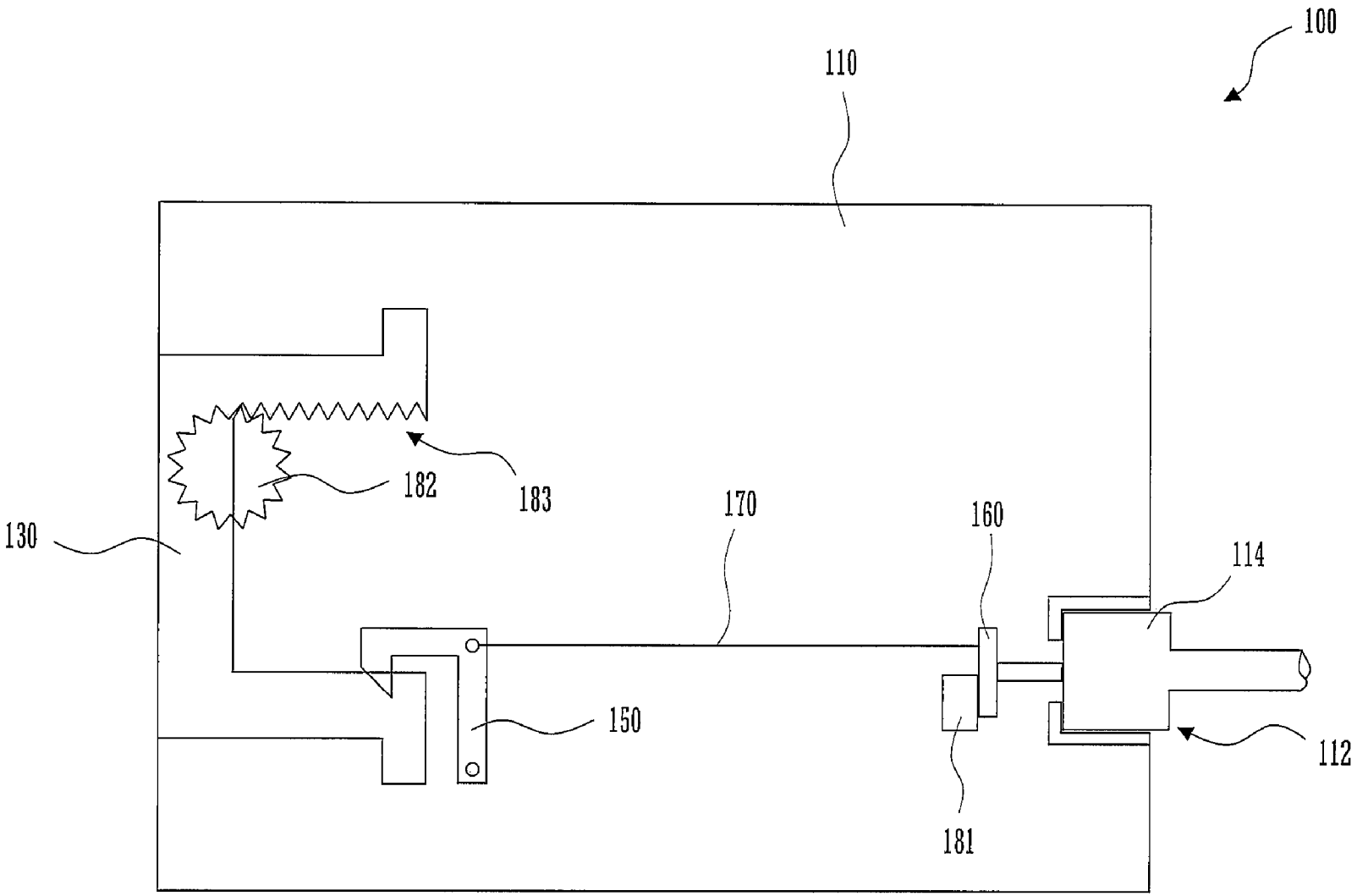
FIG. 4 is a figure showing a related structure after having transported the transportable device according to the first embodiment of the present invention.

FIG. 3 and FIG. 4 are figures showing a related structure after having transported the transportable device 100 according to the first embodiment of the present invention.

In FIG. 3 and FIG. 4, for convenience of the explanation, a structure for moving the handle 130 to the outside of the housing 110 is omitted. The transportable device 100 further includes a switch 181, a pinion gear 182, and a rack gear 183. The switch 181, the pinion gear 182, and the rack gear 183 collectively correspond to a retracting mechanism of the present invention. The pinion gear 182 corresponds to a first pinion gear portion of the present invention. The rack gear 183 corresponds to a first rack gear portion of the present invention. The rack gear 183 forms a part of the handle 130.

The switch 181, the pinion gear 182, and the rack gear 183 collectively form a mechanism for moving the handle 130 to the inside of the housing 110 by linking with the lever portion 160 moving in the insertion direction of the power plug 114.

The handle 130 moves to the inside of the housing 110 by the switch 181, the pinion gear 182, and the rack gear 183 by linking with the power plug 114 being inserted into the power plug insertion opening 112, and then the lever portion 160 moving in the insertion direction of the power plug 114.

The following describes the operation of each portion when the handle 130 moves to the inside of the housing 110. FIG. 3 shows a state before the handle 130 moves to the inside of the housing 110. In the example shown, the lever portion 160 moves to the insertion direction of the power plug 114 when the power plug 114 is inserted into the power plug insertion opening 112. In a state in which the power plug 114 is completely inserted into the power plug insertion opening 112, the lever portion 160 moves to a position where the lever portion presses down the switch 181.

When the switch 181 is pressed down by the lever portion 160 and then electric power is supplied to a motor, which is not shown, the motor rotates at a predetermined angle and accordingly the pinion gear 182 rotates at a predetermined angle in the direction of an arrow together with the motor rotation. Then, the rack gear 183 which is in mesh with the pinion gear 182 moves toward the inside of the housing 110 so that the handle 130 moves toward the inside of the housing 110. After the handle 130 has moved to the inside of the housing 110, the pinion gear 182 becomes free, that is, the pinion gear can freely rotate.

When the power plug 114 is inserted into the power plug insertion opening 112, the lock claw 150 moves, through the link portion 170 which links the lock claw 150 and the lever portion 160, to a position where the lock claw locks the handle 130. The lever portion 160 presses down the switch 181 in the state in which the lock claw 150 has moved to a position in which the lock claw locks the handle 130, so that the lock claw 150 has moved to the position where the lock claw locks the handle 130 before the handle 130 moves to the inside of the housing 110.

However, the lock claw 150 does not become an obstacle when the handle 130 moves to the inside of the housing 110. It is because the lock claw 150 is made of an elastic member, the tip of the claw has a predetermined angle, and thereby the lock claw 150 is elastically deformed by pressing of the handle 130 when the handle 130 moves to the inside of the housing 110.

In this way, the handle 130 automatically moves to the inside of the housing 110 as the power plug 114 is inserted into the power plug insertion opening 112, so that a user does not forget to move the handle 130 to the inside of the housing 110. In addition, the handle 130 does not become an obstacle when the transportable device 100 is used because the handle 130 has moved (in a retracted state) to the inside of the housing 110.

Figure 5:
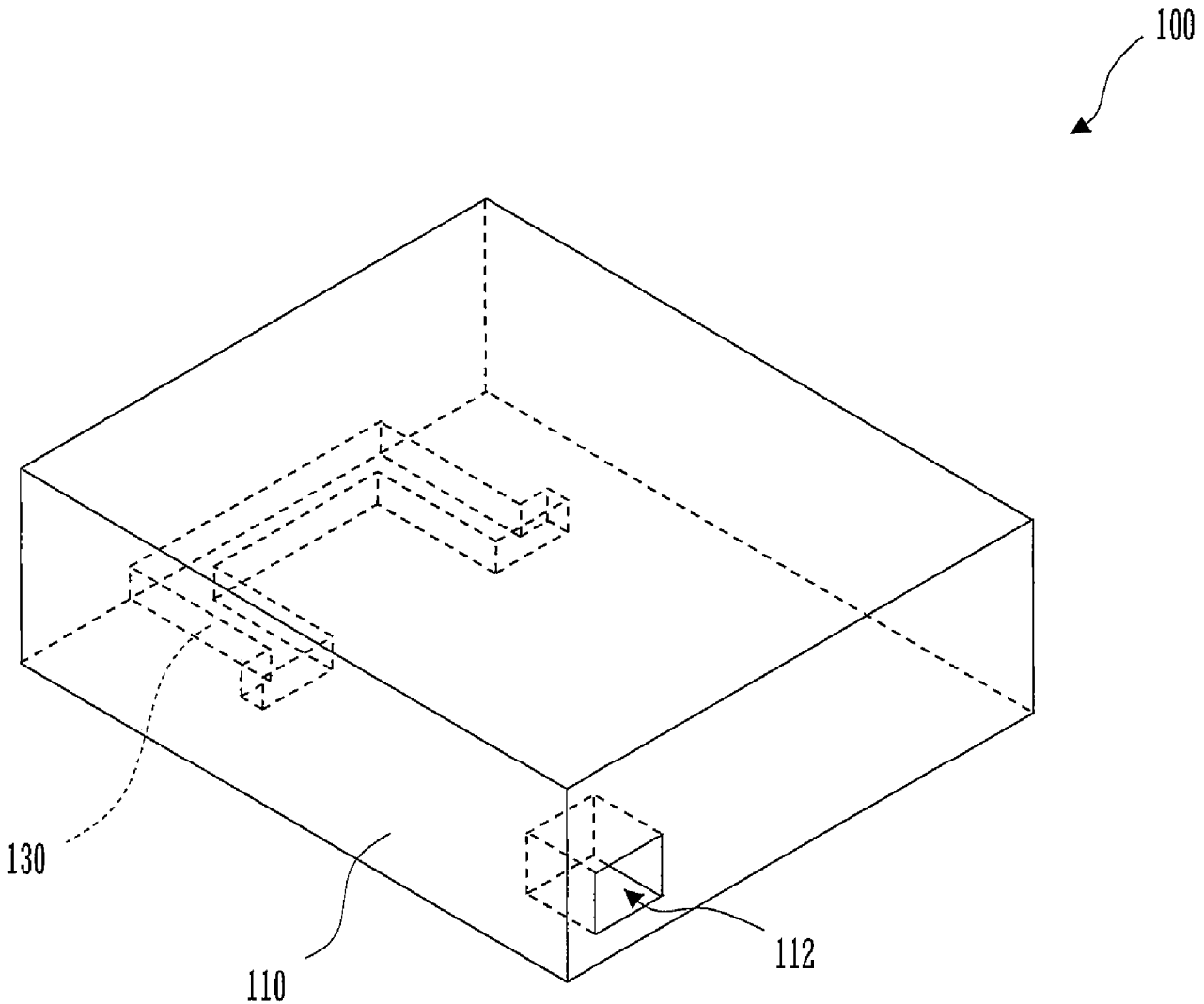
FIG. 5 is a figure showing an appearance of the transportable device according to the first embodiment of the present invention.

FIG. 5 is a figure showing an appearance of the transportable device 100 according to the first embodiment of the present invention.

As shown in FIG. 5, the housing 110 of the transportable device 100 preferably has no portion which a user can hold. Since the housing 110 does not have the portion which a user can hold, the user transports the transportable device 100 only by holding the handle 130. In other words, in the present embodiment, the handle 130 does not move to the outside of the housing as long as the power plug 114 is not pulled out of the power plug insertion opening 112. For this reason, a risk that the transportable device 100 may be transported in a state in which the power plug 114 is inserted into the power plug insertion opening 112 can be avoided.

Thus, a situation where a user forcibly transports the transportable device 100 in the state in which the power plug 114 is inserted into the power plug insertion opening 112 does not occur, which can avoid generation of damage to the power cord due to a load being applied to the power cord. In addition, since tension from the power cord is not applied to the transportable device, a risk that the user drops the transportable device because his or her hands slip due to the tension can be also avoided.

Subsequently, description will be made of a second embodiment of the present invention.

Figure 6:
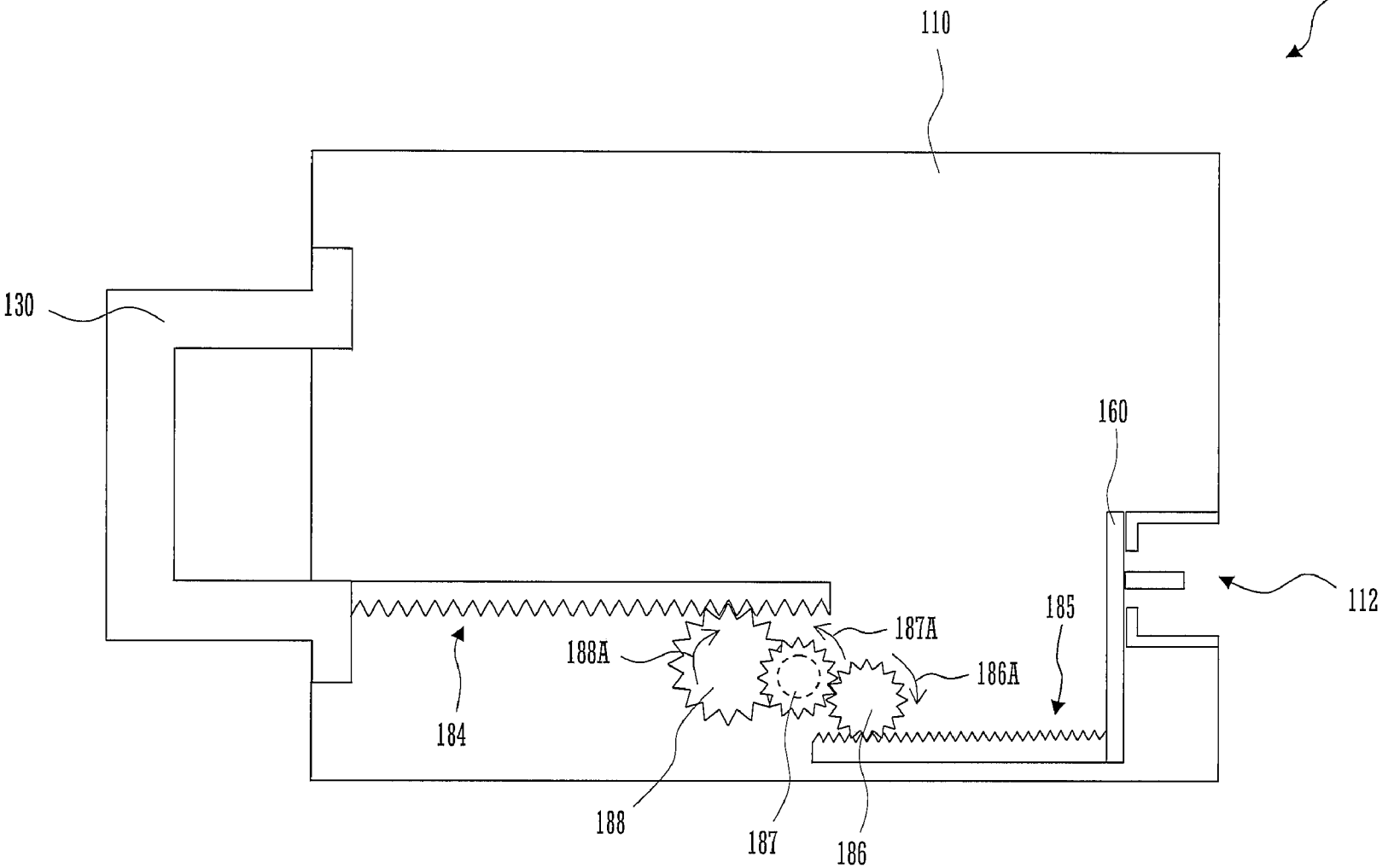
FIG. 6 is a figure showing a related structure after having transported a transportable device according to a second embodiment of the present invention.
Figure 7:
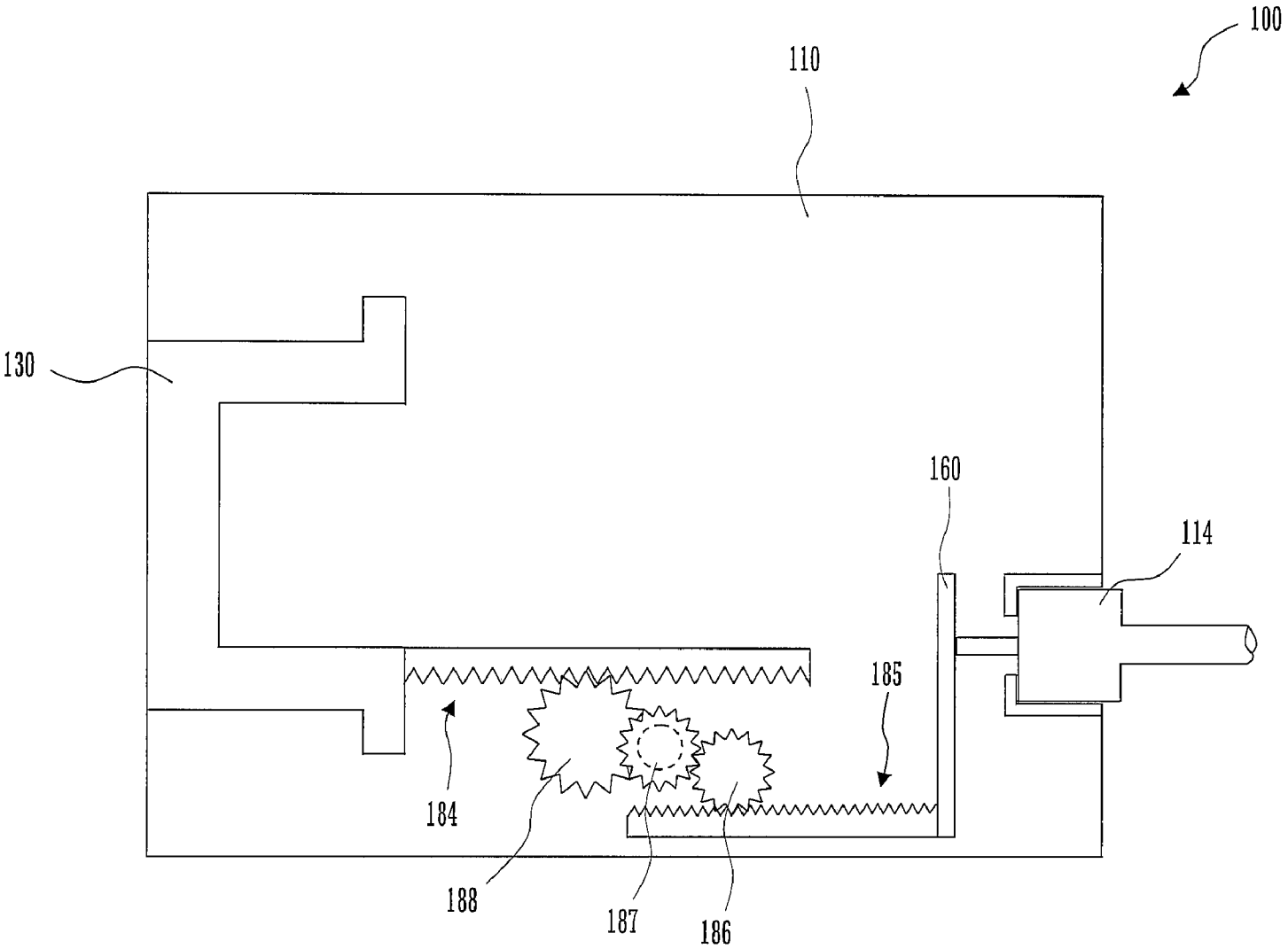
FIG. 7 is a figure showing a related structure after having transported the transportable device according to the second embodiment of the present invention.

FIG. 6 and FIG. 7 are figures showing a related structure after having transported the transportable device 100 according to the second embodiment of the present invention.

In the second embodiment and the embodiments subsequent thereto, redundant description will not be made of the features having been already described in relation to the first embodiment.

In FIG. 6 and FIG. 7, a structure for moving the handle 130 to the outside of the housing 110 is omitted for convenience of description. The transportable device 100 further includes a rack gear 184, a rack gear 185, a pinion gear 186, a gear 187, and a pinion gear 188. The rack gear 184, the rack gear 185, the pinion gear 186, the gear 187, and the pinion gear 188 collectively correspond to a retracting mechanism of the present invention.

The rack gear 184 corresponds to a second rack gear portion of the present invention. The rack gear 185 corresponds to a third rack gear portion of the present invention. The pinion gear 186, the gear 187, and the pinion gear 188 collectively correspond to a second pinion gear portion of the present invention. The rack gear 184 is linked to the handle 130. The rack gear 185 is linked to the lever portion 160.

The rack gear 184, the rack gear 185, the pinion gear 186, the gear 187, and the pinion gear 188 form a mechanism for moving the handle 130 to the inside of the housing 110 by linking with the lever portion 160 moving to the insertion direction of the power plug 114.

The handle 130 is moved to the inside of the housing 110 by the rack gear 184, the rack gear 185, the pinion gear 186, the gear 187, and the pinion gear 188 by linking with the power plug 114 being inserted into the power plug insertion opening 112, and the lever portion 160 moving in the insertion direction of the power plug 114.

The following describes the operation of each portion when the handle 130 moves to the inside of the housing 110. FIG. 6 shows a state before the handle 130 moves to the inside of the housing 110. In the example shown, the lever portion 160 moves in the insertion direction of the power plug 114 when the power plug 114 is inserted into the power plug insertion opening 112. Accordingly, the rack gear 185 also moves in the insertion direction of the power plug 114.

Then, the pinion gear 186, which is in mesh with the rack gear 185, rotates in the direction of an arrow 186A. By accompanying the rotation, the gear 187, which is in mesh with the pinion gear 186, rotates in the direction of an arrow 187A. Furthermore, the pinion gear 188, which is in mesh with the gear 187, rotates in the direction of an arrow 188A. As the pinion gear 188 rotates in the direction of the arrow 188A, the rack gear 184, which is mesh with the pinion gear 188, moves to the inside of the housing 110, so that the handle 130, which is linked with the rack gear 184, moves to the inside of the housing 110. FIG. 7 shows a state after the handle 130 has moved to the inside of the housing 110.

The present embodiment includes three gears: the pinion gear 186, the gear 187, and the pinion gear 188 between the rack gear 184 and the rack gear 185 to secure an amount of movement required for the handle 130 to move to the inside of the housing 110. That is to say, the pinion gear 186, the gear 187, and the pinion gear 188 form a mechanism for adjusting an amount of movement of the rack gear 185 (an amount of movement of the lever portion 160) and an amount of the movement of the handle 130. It is to be noted that the three gears: the pinion gear 186, the gear 187, and the pinion gear 188 can be appropriately increased and decreased. For example, any one of the gears may be used.

In this way, the handle 130 automatically moves to the inside of the housing 110 as the power plug 114 is inserted into the power plug insertion opening 112, so that a user does not forget to move the handle 130 to the inside of the housing 110. In addition, the handle 130 does not become an obstacle when the transportable device 100 is used because the handle 130 has moved (in a retracted state) to the inside of the housing 110.

Subsequently, description will be made of a third embodiment of the present invention.

The handle 130 may be structured to be manually moved to the inside of the housing 110. With this structure, a user pushes the handle 130 into the inside of the housing 110 when using the transportable device 100. This structure is effective in the case such as where the retracting mechanism shown in the first embodiment or the second embodiment temporarily breaks down. In addition, there is no risk that a hand of a user is is pinched by the handle 130 because the user himself or herself pushes the handle 130 into the inside of the housing 110, which means that the handle 130 is not forcibly moved to the inside of the housing 110.

Subsequently, description will be made of a fourth embodiment of the present invention.

Figure 8:
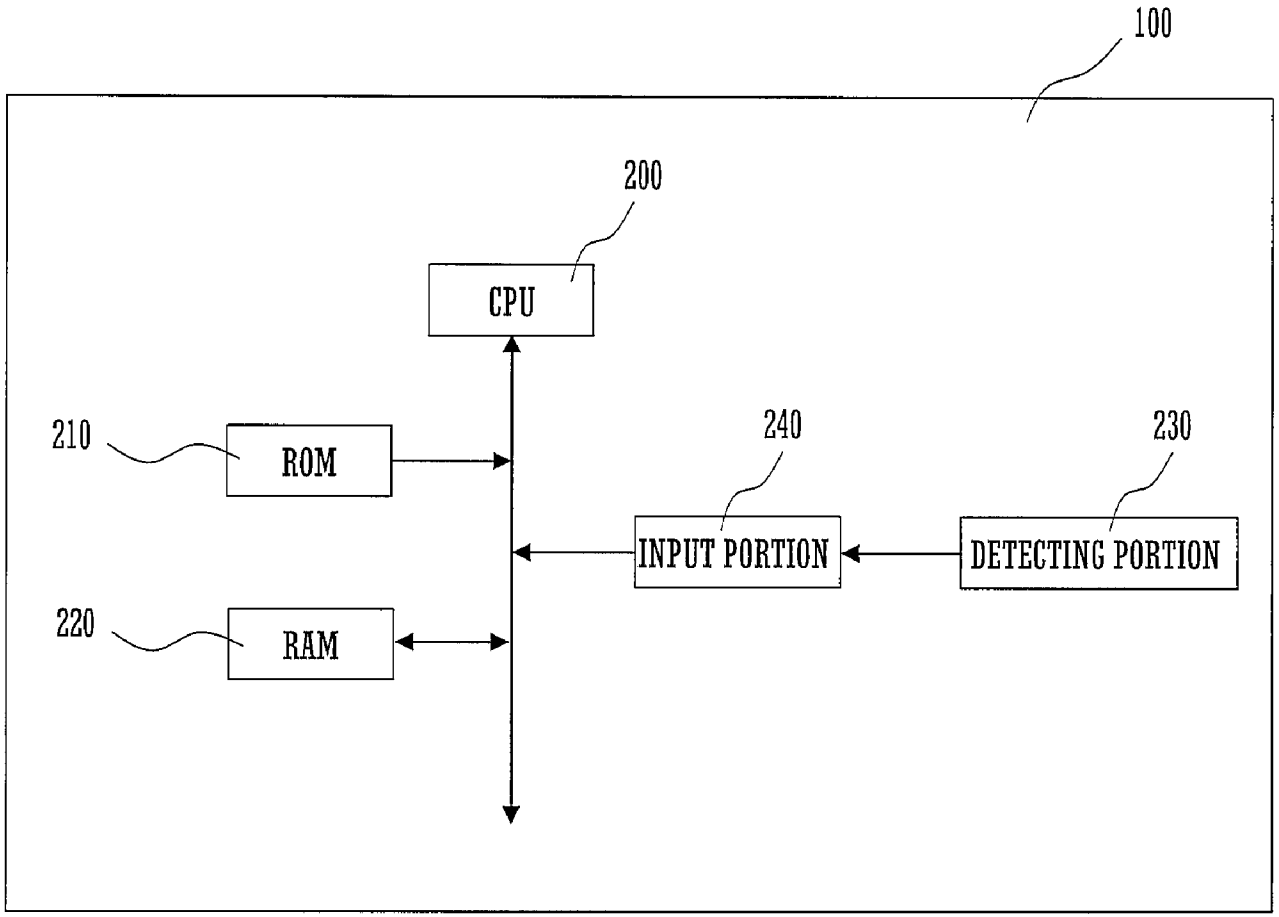
FIG. 8 is a figure showing a control mechanism of a transportable device according to a fourth embodiment of the present invention.

FIG. 8 is a figure showing a control mechanism of a transportable device 100 according to the fourth embodiment of the present invention.

The transportable device 100 includes a CPU 200, a ROM 210, a RAM 220, a detecting portion 230, and an input portion 240. The CPU 200 corresponds to a control portion of the present invention.

The CPU 200 reads and executes a control program from the ROM 210, and controls individual portions of the transportable device 100 comprehensively. The RAM 220 is utilized as a working area of the CPU 200. The detecting portion 230 detects a state (a retracted state) in which the handle 130 is positioned in the inside of the housing 110. The input portion 240 inputs a detection signal from the detecting portion 230 to the CPU 200 as a signal which makes the operation of the transportable device 100 effective. Then, the CPU makes the operation of the transportable device 100 effective when determining that the signal is inputted from the input portion 240.

In this structure, the operation of the transportable device 100 becomes effective (the transportable device 100 can be used) only when the handle 130 is positioned in the inside of the housing 110 (when the handle is in a retracted state). By this structure, the handle 130 needs to be positioned in the inside of the housing 110 in order that the transportable device 100 is operated, so that the transportable device 100, in the state in which the power plug 114 is inserted into the power plug insertion opening 112, cannot be transported by a user.

Thus, a situation where a user transports the transportable device 100 by holding the handle 130 does not occur in a state in which the power plug 114 is inserted into the power plug insertion opening 112, that is, a state in which the operation of the transportable device 100 is effective, so that occurrence of damage to the power cord due to the load being applied to the power cord can be avoided. In addition, a risk that the user drops the transportable device 100 because his or her hands slip from the handle 130 due to the tension can be also avoided since tension from the power cord is not applied to the transportable device 100.

Figure 9:
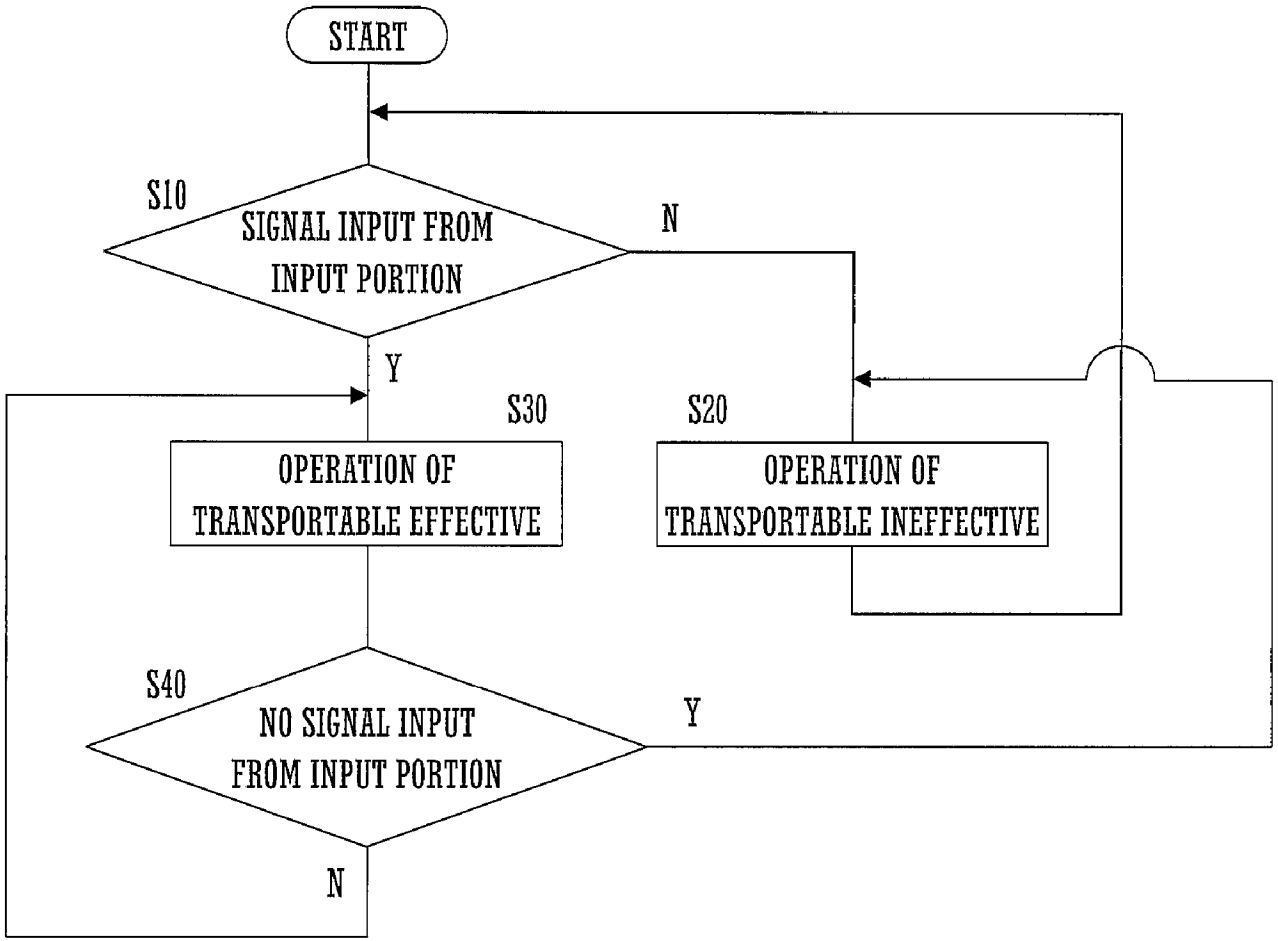
FIG. 9 is a flowchart showing control contents of a CPU of the transportable device according to the fourth embodiment of the present invention.

FIG. 9 is a figure showing control contents of the CPU 200 of the transportable device 100 according to the fourth embodiment of the present invention.

The CPU 200 determines whether a signal is inputted from the input portion 240 (step S10). When determining that a signal is not inputted from the input portion 240 (N in step S10), the CPU 200 controls the operation of the transportable device 100 to be made ineffective (step S20). When determining that a signal is inputted from the input portion 240 (Y in step S10), the CPU 200 controls the operation of the transportable device 100 to be made effective (step S30). Then, only when determining that a signal is inputted from the input portion 240 (N in step S40), the CPU 200 controls the operation of the transportable device 100 to be kept effective (step S30).

When determining that a signal is no longer inputted from the input portion 240 (Y in step S40), the CPU 200 controls the operation of the transportable device 100 to be made ineffective (step S20). Then, only when determining that a signal is not inputted from the input portion 240 (N in step S10), the CPU 200 controls the operation of the transportable device 100 to be kept ineffective (step S20).

In this structure, the handle 130 is detected by the detecting portion 230 only when the handle 130 is positioned in the inside of the housing 110 (when in the retracted state), so that the operation of the transportable device 100 becomes effective (the transportable device 100 can be used) by a detection signal from the detecting portion 230 when the signal is transmitted to the input portion 240 and input to the CPU 200 by the input portion 240. With this structure, the handle 130 needs to be positioned in the inside of the housing 110 in order that the transportable device 100 is operated, so that the transportable device 100 cannot be transported by a user in the state in which the power plug 114 is inserted into the power plug insertion opening 112.

Thus, a situation where a user transports the transportable device 100 by holding the handle 130 does not occur in a state in which the power plug 114 is inserted into the power plug insertion opening 112, that is, a state in which the operation of the transportable device 100 is effective, occurrence of damage to the power cord due to a load being applied to the power cord can be avoided. In addition, since tension from the power cord is not applied to the transportable device 100, a risk that the user drops the transportable device 100 because his or her hands slip from the handle 130 due to the tension can be also avoided.

Additionally, in a case where the retracting mechanism shown in the first embodiment and the second embodiment breaks down, as shown in the third embodiment, and a user needs to move the handle 130 to the inside of the housing 110 manually, the handle 130 can surely have been moved to the inside of the housing 110 (set in the retracted state), so that the above-stated effects can be achieved in the present embodiment.

While "modes for carrying out the present invention" are described in the first embodiment to the fourth embodiment, it is to be noted that these embodiments can be combined as needed.

The above described embodiments are to be considered in all respects as illustrative and not restrictive. The scope of the present invention is defined not by above described embodiments but by the claims. Furthermore, the scope of the present invention is intended to include all modifications that come within the meaning and scope of the claims and any equivalents thereof.

What is claimed is:

1. A transportable device comprising:

a housing that has a power plug insertion opening into which a power plug is inserted;

a handle portion that can move between an inside and an outside of the housing;

a biasing portion that biases the handle portion in a direction in which the handle portion is moved to the outside of the housing;

a locking portion that locks the handle portion so that the handle portion is not moved to the outside of the housing by a biasing force of the biasing portion;

a lever portion that can move in an insertion direction or in a pull-out direction of the power plug around the power plug insertion opening, and moves in the insertion direction of the power plug when the power plug is inserted into the power plug insertion opening while the lever portions moves in the pull-out direction of the power plug when the power plug is pulled out; and a link portion that links the locking portion and the lever portion, wherein the locking portion locks the handle portion in response to the link portion moving as the lever portion moves in the insertion direction of the power plug in conjunction with the power plug being inserted into the power plug insertion opening and releases locking of the handle portion in response to the link portion moving as the lever portion moves in the pull-out direction of the power plug in conjunction with the power plug being pulled out of the power plug insertion opening, and the handle portion is moved to the outside of the housing by the biasing force by the biasing portion when the power plug is pulled out of the power plug insertion opening and then the locking by the locking portion is released.

2. The transportable device according to claim 1, further comprising a retracting mechanism of the handle portion, wherein the handle portion is moved to the inside of the housing by the retracting mechanism as the lever portion moves in the insertion direction of the power plug in conjunction with the power plug being inserted into the power plug insertion opening.

3. The transportable device according to claim 2, wherein:

the retracting mechanism includes a switch portion, a first pinion gear portion, and a first rack gear portion, the first pinion gear portion being capable of freely rotating after rotating at a predetermined angle by the switch portion that is pressed down by the lever portion, and the first rack gear portion being in mesh with the first pinion gear portion and forming a part of the handle portion; and the switch portion is pressed down and then the first pinion gear portion rotates at a predetermined angle as the lever portion moves in the insertion direction of the power plug, so that the handle portion moves to the inside of the housing.

4. The transportable device according to claim 2, wherein:

the retracting mechanism includes a second rack gear portion that is linked to the handle portion, a third rack gear portion that is linked to the lever portion, and a second pinion gear portion that links the second rack gear portion and the third rack gear portion; and the third rack gear portion links the second rack gear portion through the second pinion gear portion as the lever portion moves in the insertion direction of the power plug, so that the handle portion moves to the inside of the housing.

5. The transportable device according to claim 1, wherein the handle portion is manually moved to the inside of the housing.

6. The transportable device according to claim 1, wherein the housing includes no portion to be held.

7. The transportable device according to claim 1, further comprising:

a detecting portion that detects a state in which the handle portion is positioned in the inside of the housing;

a control portion that controls operation of the transportable device;

an input portion that inputs a detection signal from the detecting portion to the control portion as a signal that makes the operation of the transportable device effective, wherein the control portion makes the operation of the transportable device effective when the control portion determines that the control portion receives a signal inputted from the input portion.

* * * * *